US006176687B1

(12) United States Patent
Kim et al.

(10) Patent No.: US 6,176,687 B1
(45) Date of Patent: Jan. 23, 2001

(54) RESONATOR FOR ROTARY COMPRESSOR

(75) Inventors: Jin Dong Kim, Kunpo; Byung Chan Lee, Seoul, both of (KR)

(73) Assignee: LG Electronics Inc., Seoul (KR)

( * ) Notice: Under 35 U.S.C. 154(b), the term of this patent shall be extended for 0 days.

(21) Appl. No.: 09/333,958

(22) Filed: Jun. 16, 1999

(30) Foreign Application Priority Data

Jul. 15, 1998 (KR) ..... 98/28598

(51) Int. Cl.[7] ..... F04B 39/00
(52) U.S. Cl. ..... 417/312; 137/855; 181/403
(58) Field of Search ..... 417/312; 137/855, 137/856; 181/403, 200, 202, 207, 224

(56) References Cited

U.S. PATENT DOCUMENTS

| | | | | |
|---|---|---|---|---|
| 2,229,119 | * | 1/1941 | Nichols et al. | 181/47 |
| 3,193,193 | * | 7/1965 | Gerteis | 230/232 |
| 4,573,879 | * | 3/1986 | Uetuji et al. | 417/312 |
| 4,573,881 | * | 3/1986 | Romer | 417/312 |
| 4,884,956 | * | 12/1989 | Fujitani et al. | 418/15 |
| 4,979,879 | * | 12/1990 | DaCosta | 417/312 |
| 5,203,679 | * | 4/1993 | Yun et al. | 417/312 |

* cited by examiner

*Primary Examiner*—Timothy S. Thorpe
*Assistant Examiner*—Timothy P. Solak

(57) ABSTRACT

A resonator for a rotary compressor is provided to prevent generation of impact exciting force and pulsation sound occurred due to pressure pulsation and reduce a noise of a low frequency band generated in the compressor by forming a curved portion at a narrow unit of the resonator which is a pressure pulsation inflow path and controlling the ratio of a diameter to a length of each of the narrow unit and a resonance unit, for thereby smoothing the inflow of the pressure pulsation generated from a pressure chamber. To achieve such a resonator, in a resonator for a rotary compressor, which consists of a narrow unit serving as an inflow path of pressure pulsation which is generated from a compressor and communicating with an exhaust outlet and a resonance unit for reducing a noise by attenuating the pressure pulsation element flowed through the narrow unit, the improved resonator for the rotary compressor according to the present invention includes a curved portion formed at an end portion of the narrow unit. In addition, the ratio of a radius of the curved portion to a diameter of the narrow unit is 2.5~3.5:1, the ratio of the diameter of the exhaust outlet to the diameter of the resonance unit is 1.2~1.8:1, the ratio of the diameter to the height of the resonance unit is 1.0~2.5:1, and the ratio of the length to the diameter of the narrow unit is 1.5~2.8:1.

5 Claims, 5 Drawing Sheets

RESONATOR FOR ROTARY COMPRESSOR

BACKGROUND OF THE INVENTION

1. Field of the Invention

The present invention relates to a rotary compressor, and more particularly to a resonator for a rotary compressor which prevents generation of impact exciting force and pulsation sound occurred due to pressure pulsation and reduces a noise of a low frequency band generated in the compressor by forming a curved portion at a narrow unit of the resonator which is a pressure pulsation inflow path and controlling the ratio of dimensions of the narrow unit and a resonance unit, for thereby smoothing the inflow of the pressure pulsation generated from a pressure chamber.

2. Description of the Conventional Art

Generally, a compressor which constitutes a cooling cycle device such as an evaporator, an accumulator, etc. is an apparatus that compresses air or coolant gas by the rotation of an impeller or a rotor, or the reciprocation of a piston, the compressor consisting of a power unit system for driving the impeller, the rotor or the piston and a compression unit for sucking and compressing gas by the driving force transmitted from the power unit system.

Such a compressor is divided into two types, a hermetic type and a separate type, in accordance with a layout of the power unit system and the compression unit. According to the hermetic type, the power unit system and the compression unit are disposed together in a predetermined hermetic vessel, while as for the separate type the power unit system is located out of the hermetic vessel so that the driving force generated from the power unit system is transmitted to the compression unit in the hermetic vessel, the hermetic compressor being divided into, according to a system of compressing the gas, rotary, reciprocating, linear and scroll compressors.

In the conventional rotary compressor among the hermetic type compressors, as shown in FIG. 1, a compression unit and a motor unit for driving the compression unit are installed in a hermetic vessel 1 of a hollow cylindrical shape wherein a crank axle 4 is provided, the compression unit and the motor unit performing compressing of a coolant gas which is flowed into the hermetic vessel 1, in accordance with the power application.

More specifically, in the motor unit, a stator 2 is fixed to an inner wall of the hermetic vessel 1, a ring-shaped rotor 3 is installed in the stator 2 and the crank axle 4 is pressedly inserted in the rotor 3, so that when magnetic force is generated in the stator 2 in accordance with the power application, the rotor 3 rotates by virtue of induced electromotive force which is produced by the interaction between the rotor 3 and the stator 2 and accordingly the crank axle 4 rotates in conjunction with the rotor 3.

Further, the compression unit, as shown in FIG. 2, is provided with a roller 5 which is eccentrically disposed at a bottom of the crank axle 4 and performs suction, compression and exhaust of the coolant while rotating having a certain eccentric track in accordance with the rotation of the crank axle 4, a cylinder 6 which has a slot 9 at an inner wall thereof, the slot 9 having a vane 12 which separates a suction chamber 10 and a compression chamber 11 while reciprocating therein in accordance with the rotation of the roller 5, a main bearing 7 and a sub bearing 8 that support the compression unit at upper and lower parts of the cylinder 6, a suction inlet 13 and an exhaust outlet 14 which are flow paths of the coolant that is sucked/exhausted to/from the cylinder 6, and a muffler 15 disposed at an upper portion of the exhaust outlet 14 in order to reduce the exhaust noise, so that the compression unit compresses and exhausts the coolant which has been flowed through the suction inlet 13 into the cylinder 6.

In the thusly configured rotary compressor, when the magnetic force is generated from the stator 2 by the power application, the rotor 3 rotates by the induced electromotive force, thereby rotating the crank axle 4 which is pressedly inserted therein. Then, the roller 5 which is eccentrically disposed at the bottom of the crank axle 4 revolves itself and around an inner circumferential surface of the cylinder 6 while having the certain eccentric track, thereby generating suction force, so that the coolant gas is flowed through the suction inlet 13 to the suction chamber 10.

Next, when the roller 5 further rotates for predetermined degrees, the compression of the coolant starts. Here, when the rotation degrees become around 200°, the pressure in the compression chamber 11 becomes identical with or greater than the exhaust pressure, so that an exhaust valve (not shown) of the exhaust outlet 14 is open, thereby exhausting the compressed coolant gas. Then, the coolant gas which has been exhausted through the exhaust outlet 14 passes through the muffler 15 disposed at the upper part of the main bearing, rapidly expands into an inner space of the compressor and is flowed outside of the compressor through an exhaust pipe (not shown).

However, during which the above operation is repeated, pressure pulsation is generated in the process of compressing and exhausting the coolant and the impact vibration due to the pressure pulsation is travelled to the cylinder 6 which constitutes the compression unit, thereby vibrating the cylinder 6 and the hermetic vessel 1 and thus radiating the noise to the outside of the compressor. Also, strongly directional resonant sound is radiated outside of the compressor by which in the exhaust of the coolant pressure pulsation elements which are generated in the cylinder 6 rapidly expand into the inner space of the compressor, thereby exciting a sound mode thereof.

Accordingly, in the conventional rotary compressor a resonator is disposed in a middle part of the exhaust path in order to relieve the pressure pulsation which is generated in the coolant compressing process and prevent the rapid flow of the pressure pulsation during the exhausting performance.

FIG. 3 illustrates a resonator 16 of the conventional rotary compressor, which consists of a narrow unit 16*a* serves as an inflow path of the pressure pulsation and a resonance unit 16*b* attenuates the pressure pulsation flowed through the narrow unit 16*a*. Further, a frequency band for the resonator 16 is determined in accordance with size of a resonant space unit, and area and length of a pressure inflow path.

Meanwhile, 4 KHz is generally known as a frequency to which people have the most keen sense of hearing, and accordingly as for the resonator for the conventional rotary compressor the specification of each element has been determined to correspond with an objective frequency, considering only a frequency band adjacent 4 KHz.

However, in such a conventional resonator, since an edge is formed in a pressure pulsation inlet port of the narrow unit 16*a* which communicates with the exhaust outlet, the pressure pulsation elements flowed into the resonator side collide with this portion, thereby generating the vortex, so that the exhaust of the compressed coolant is obstructed and the attenuation of the pressure pulsation of the resonator is weakened, which results in increase in the flow noise.

In addition, in accordance with the recent trend of being a large-sized compressor, the compression space of the cylinder increases and accordingly the size of the compression unit and the hermetic vessel which finally radiates the noise is also increased, so that the main frequency elements of the noise which is radiated from the compressor are moved to a low frequency band. Therefore, the limits are found in the conventional resonator for the rotary compressor designed only for the 4 KHz frequency band and thus another type of the resonator suitable for the increased capacity of the compressor has been required.

Particularly, when the compressor is installed in an air conditioner, the noise can be intercepted at some extent if appropriately using a sound absorption member with respect to the high frequency noise elements adjacent to 4 KHz, but to the noise elements of the low frequency band the absorption effect is reduced, thereby causing louder grating noise.

SUMMARY OF THE INVENTION

Accordingly, the present invention is directed to a resonator for a rotary compressor which obviates the problems and disadvantages due to the conventional art.

An object of the present invention is to provide a resonator for a rotary compressor which restrains vortex generation due to pressure pulsation by smoothing the inflow of the pressure pulsation to a resonator side, for thereby achieving excellent performance of reducing a pulsation noise.

Another object of the present invention is to provide a resonator for a rotary compressor which reduces a noise element in a low frequency band of a large-size rotary compressor.

To achieve these and other advantages and in accordance with the purpose of the present invention, as embodied and broadly described, in a resonator for a rotary compressor, which consists of a narrow unit serving as an inflow path of pressure pulsation which is generated from a compressor and communicating with an exhaust outlet and a resonance unit for reducing a noise by attenuating the pressure pulsation element flowed through the narrow unit, there is provided an improved resonator for a rotary compressor which includes a curved portion formed at an end portion of the narrow unit. In addition, the ratio of a radius of the curved portion to a width of the narrow unit is 2.5~3.5:1, the ratio of the diameter of the exhaust outlet to the diameter of the resonance unit is 1.2~1.8:1, the ratio of the diameter to the height of the resonance unit is 1.0~2.5:1, and the ratio of the length to the width of the narrow unit is 1.5~2.8:1.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

It is noted that the elements which are identical to those in the conventional art will have the same reference numbers.

Figure 1:
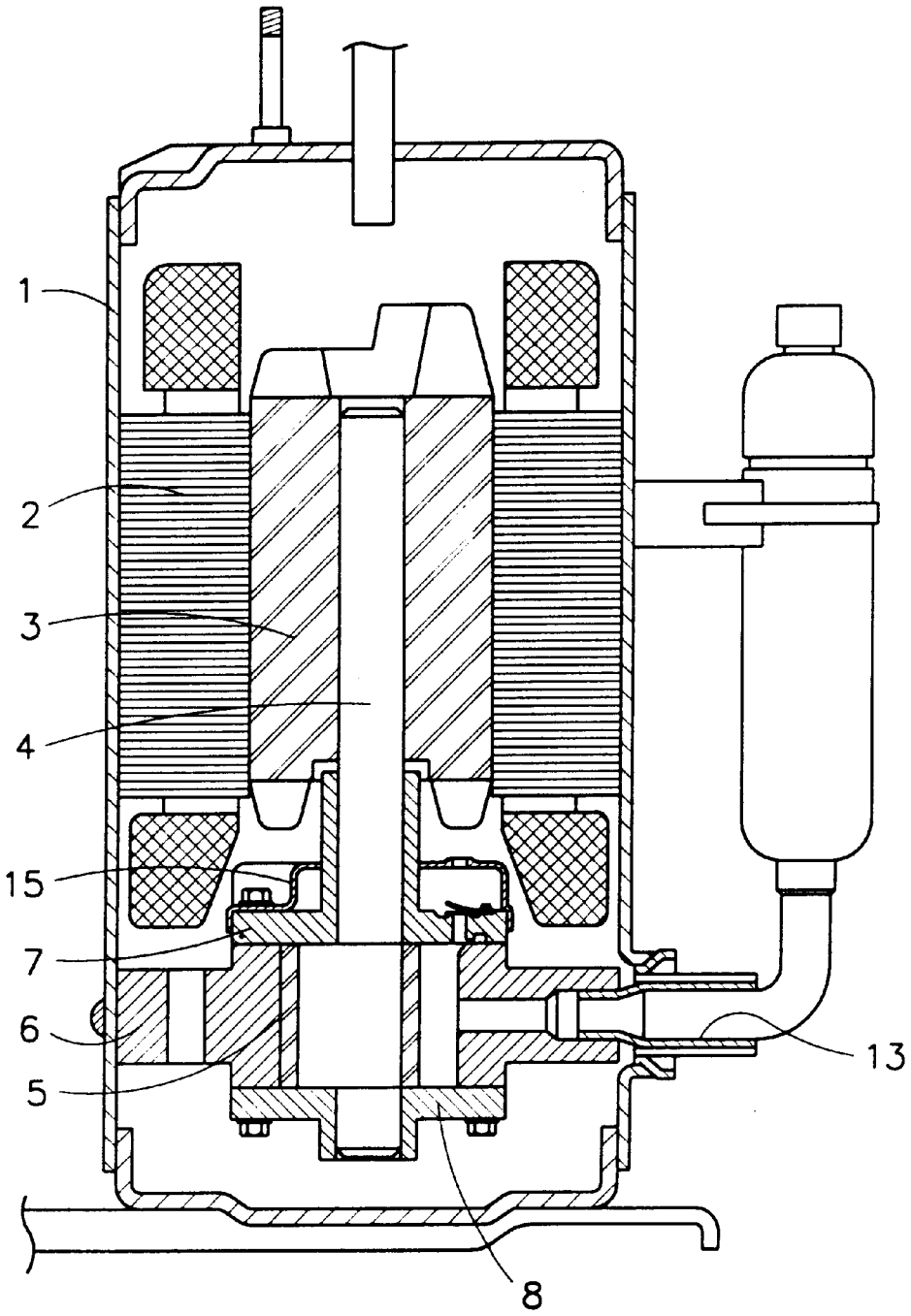
FIG. 1 CONVENTIONAL ART
FIG. 1 is a vertical cross-sectional diagram of a conventional rotary compressor.
Figure 2:
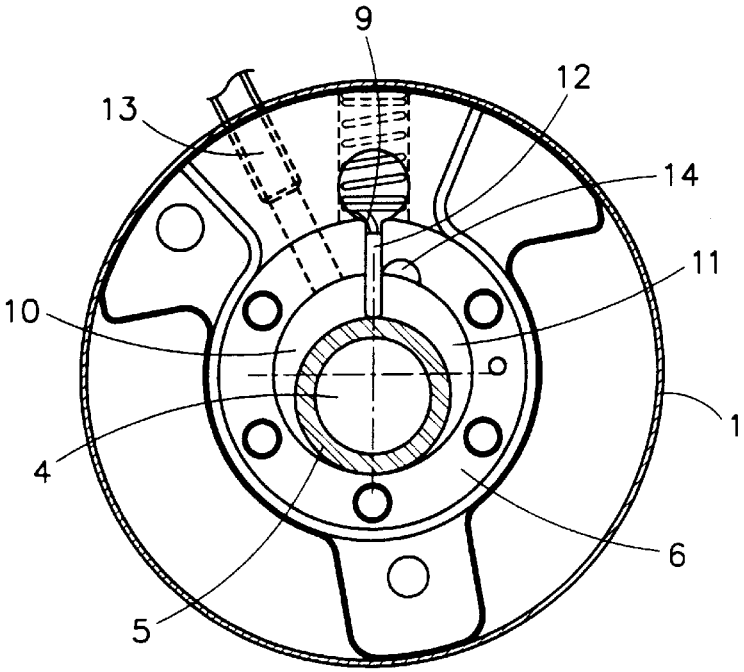
FIG.2 CONVENTIONAL ART
FIG. 2 is a horizontal cross-sectional diagram of a compression unit of the conventional rotary compressor.
Figure 3:
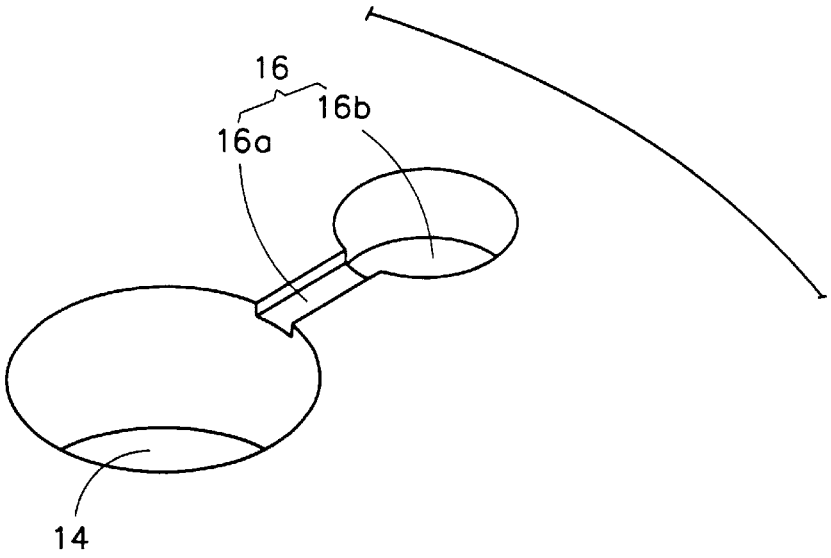
FIG.3 CONVENTIONAL ART
FIG. 3 is a diagram illustrating a resonator which is an exhaust system of the conventional rotary compressor.
Figure 4:
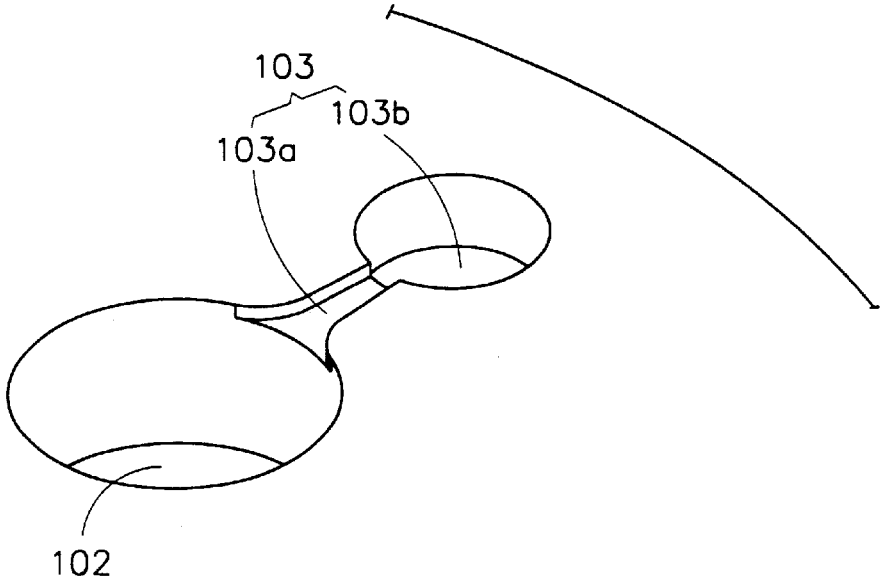
FIG. 4 is a diagram illustrating a resonator for a rotary compressor according to the present invention.
Figure 5:
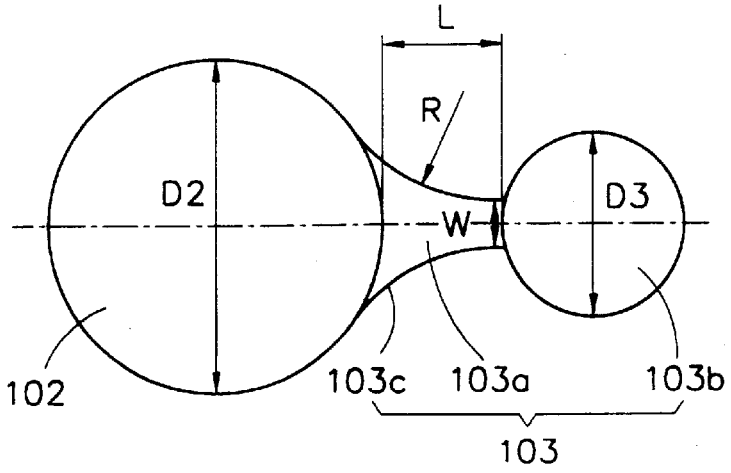
FIG. 5 is a horizontal cross-sectional diagram of the resonator for the rotary compressor according to the present invention.
Figure 6:
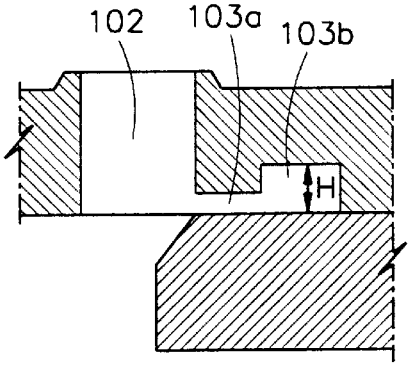
FIG. 6 is a vertical cross-sectional diagram of the resonator for the rotary compressor according to the present invention.

As shown in FIGS. 4 through 6, a resonator for a rotary compressor of the present invention, which consists of a narrow unit 103*a* serving as an inflow path of pressure pulsation which is generated from a compressor 11 and communicating with an exhaust outlet 102 and a resonance unit 103*b* attenuating a noise by relieving the pressure pulsation elements flowed through the narrow unit 103*a,* includes a curved portion 103*c* at an end of the narrow unit 103*a.*

Here, it is to be noted that the ratio of a radius R of the curved portion 103*c* to a width W of the narrow unit 103*a* is 2.5~3.5:1. Further, the ratio of a diameter D2 of the exhaust outlet 102 to a diameter D3 of the resonance unit 103*b* is to be 1.2~1.8:1, the ratio of the diameter D3 to a height H of the resonance unit 103*b* is 1.0~2.5:1, and the ratio of a length L to the width W of the narrow unit 103*a* is to be 1.5~2.8:1.

In such a rotary compressor having the above configuration of the resonator 103 according to the present invention, pressure pulsation elements which are periodically generated in the process of compressing and exhausting the coolant by virtue of a roller 5 which eccentrically rotates along an inner circumferential surface of a cylinder 6 is flowed to the resonance unit 103*b* through the narrow unit 103*a* of the resonator 103 communicating with the exhaust outlet 102.

Here, since the curved portion 103*c* is formed at the end of the narrow unit 103*a,* the pressure pulsation elements generated from the pressure 11 are smoothly flowed into the resonance unit 103*b,* thereby preventing the generation of a vortex occurred by the collision of the pressure pulsation elements of various frequencies with a pressure pulsation inlet port of the narrow unit 103*a* and thus effectively attenuating the pressure pulsation through the smooth inflow of the pressure pulsation into the resonator side.

Figure 7:
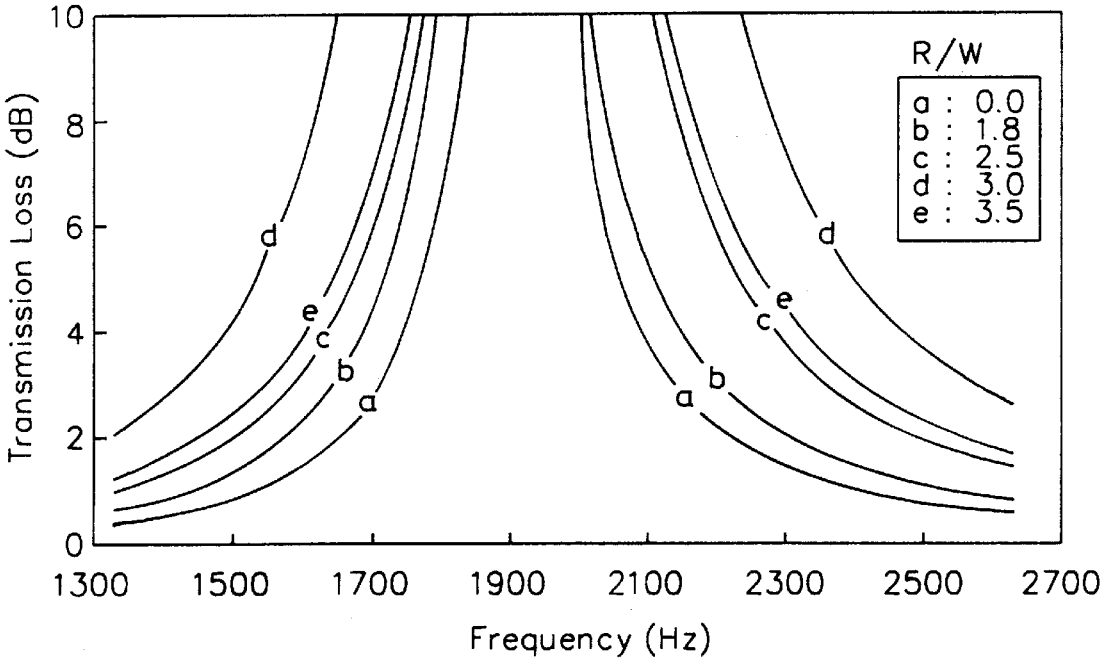
FIG. 7 is a graph illustrating a noise reduced characteristic of the resonator for the rotary compressor according to the present invention.

Further, in order to maximize the reduced effect of the pulsation noise, as shown in FIG. 7, according to the result of an experiment for testing how the ratio of the radius R of the curved portion 103*c* to the width W of the narrow unit 103*c* affects the generation of the pulsation noise while varying the ratio thereof, it is shown that the noise reduction is maximized when the ratio of the radius R of the curved portion 103*c* to the width W of the narrow unit 103*c* is 2.5~3.5:1.

Accordingly, as for the resonator 103 for the rotary compressor of the present invention, the ratio of the radius R of the curved portion 103*c* to the width W of the narrow unit 103*c* is set as 2.5~3.5:1.

Also, to minimalize the noise elements of the low frequency band (0.5~2 KHz) which have not been considered in the conventional art, as for the resonator for the rotary compressor according to the present invention, it is designed that the ratio of the diameter D2 of the exhaust outlet 102 to the diameter D3 of the resonance unit 103*b* is 1.2~1.8:1, the ratio of the diameter D3 to the height H of the resonance unit 103*b* is 1.0~2.5:1, and the ratio of the length L to the width W of the narrow unit 103*a* is 1.5~2.8:1.

Figure 8:
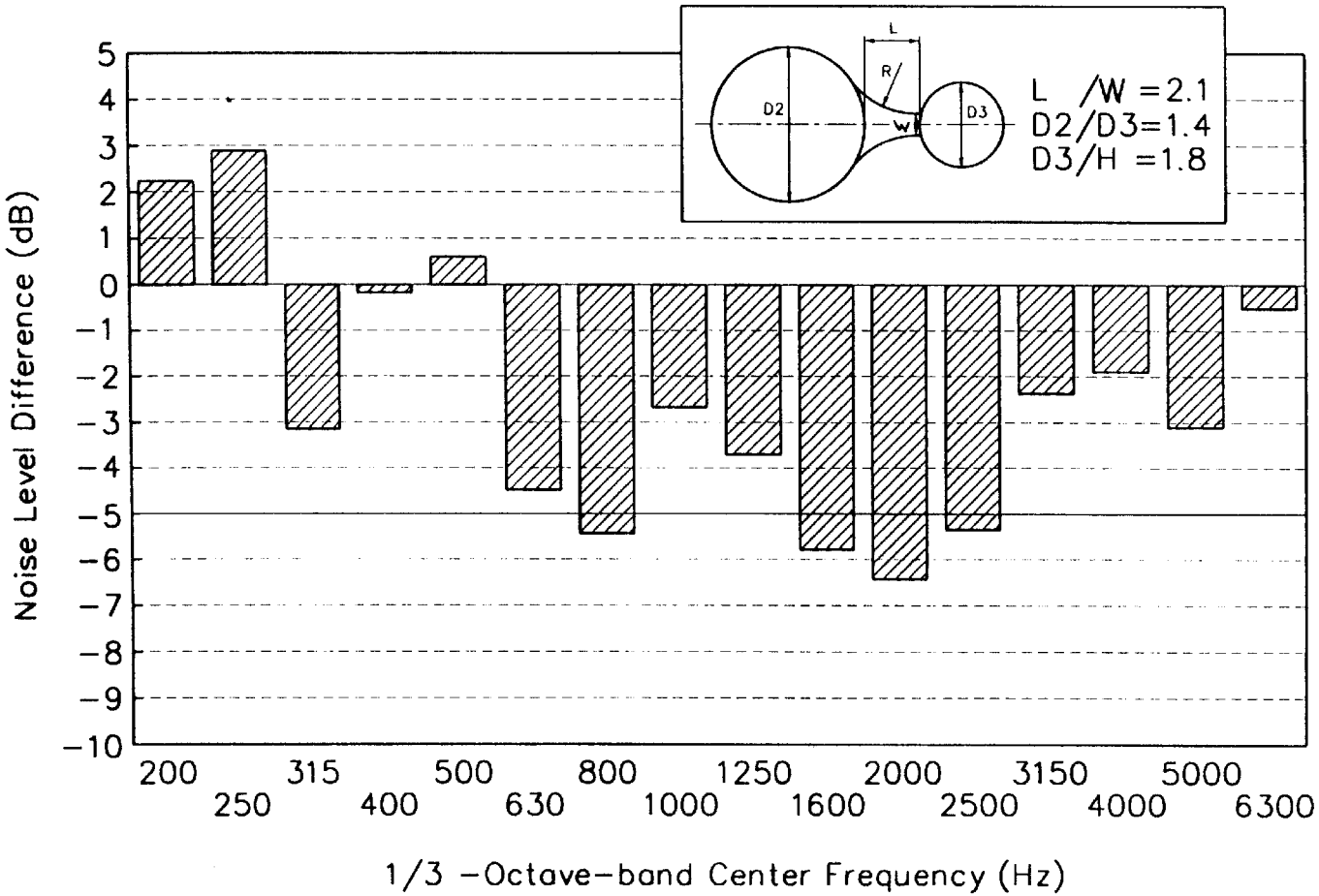
FIG. 8 is a graph illustrating an application effect of the resonator for the rotary compressor according to the present invention.

While, FIG. 8 is a graph illustrating noise level difference according to the change of the resonator, wherein the application noise level of the conventional resonator is deducted from the application noise level of the improved resonator according to the present invention.

As described above, according to the present invention, the pressure pulsation elements generated in the pressure chamber can be smoothly flowed into the resonance unit by which the curved portion is formed at the end portion of the narrow unit of the resonator and the ratio of the radius of the curved portion to the diameter of the narrow unit is controlled to be 2.5~3.5:1, thereby preventing the vortex generation and thus reducing the pulsation noise.

Also, according to the present invention, the ratio of the diameter of the exhaust outlet to the diameter of the resonance unit is 1.2~1.8:1, the ratio of the diameter to the height of the resonance unit is 1.0~2.5:1, and the ratio of the length to the width of the narrow unit is 1.5~2.8:1, thereby reducing the noise of the low frequency band which is problematically generated in the conventional rotary compressor and especially having an effect of considerably reducing the noise in the low frequency band of the large-size rotary compressor.

It will be apparent to those skilled in the art that various modifications and variations can be made in the resonator for the rotary compressor of the present invention without departing from the spirit or scope of the invention. Thus, it is intended that the present invention cover the modifications and variations of this invention provided they come within the scope of the appended claims and their equivalents.

What is claimed is:

1. A resonator for a rotary compressor comprising:

a body including a body inlet for connecting to an exhaust outlet of the compressor, a body outlet for connecting to an inlet of a resonance unit of the compressor, and a narrow path provided between the inlet and the outlet and being defined by a plurality of sidewalls, at least one of the sidewalls being continuously curved.

2. The resonator of claim 1, wherein the narrow path has a larger width at positions closer to the body inlet than at positions closer to the body outlet.

3. The resonator of claim 1, wherein a ratio of a radius of a circle drawn such that an arc of the circle coincides with the curved sidewall to a smallest width of the narrow path is between 2.5:1 and 3.5:1.

4. The resonator of claim 1, wherein a ratio of a length of the narrow path to a smallest width of the narrow path is between 1.5:1 and 2.8:1.

5. The resonator of claim 4, further comprising the resonance unit and the exhaust outlet and wherein a ratio of a diameter of the exhaust outlet to a diameter of the resonance unit is between 1.2:1 and 1.8:1 and a ratio of the diameter of the resonance unit to a height of the resonance unit is between 1.0:1 and 2.5:1.

* * * * *